US009062941B2

(12) United States Patent
Grundler et al.

(10) Patent No.: US 9,062,941 B2
(45) Date of Patent: Jun. 23, 2015

(54) ENCAPSULATED EFFECT BODY FOR AN INFRARED DECOY

(71) Applicant: RHEINMETALL WAFFE MUNITION GMBH, Unterluess (DE)

(72) Inventors: Johannes Grundler, Neuenburg (DE); Juergen Hofmann, Salzwedel (DE); Rainer Gaisbauer, Schoenau (DE); Markus Jung, Eicklingen (DE); Michael Koepf, Muellheim (DE)

(73) Assignee: Rheinmetall Waffe Munition GmbH, Unterluess (DE)

( * ) Notice: Subject to any disclaimer, the term of this patent is extended or adjusted under 35 U.S.C. 154(b) by 0 days.

(21) Appl. No.: 13/627,451

(22) Filed: Sep. 26, 2012

(65) Prior Publication Data

US 2013/0036932 A1 Feb. 14, 2013

Related U.S. Application Data

(63) Continuation of application No. PCT/EP2011/001008, filed on Mar. 2, 2011.

(30) Foreign Application Priority Data

Mar. 26, 2010 (DE) ..... 10 2010 013 110

(51) Int. Cl.

| | |
|---|---|
| ***F42B 12/70*** | (2006.01) |
| ***F42B 12/48*** | (2006.01) |
| ***F42B 4/26*** | (2006.01) |
| ***F42B 4/24*** | (2006.01) |

(Continued)

(52) U.S. Cl.

CPC ... *F41J 2/02* (2013.01); *F42B 4/26* (2013.01); *F42B 12/70* (2013.01); *F42B 4/24* (2013.01); *F42B 12/48* (2013.01); *F42B 12/36* (2013.01)

(58) Field of Classification Search

CPC ..... F42B 4/00; F42B 4/02; F42B 4/24; F42B 4/26; F42B 4/28; F42B 12/36; F42B 12/38; F42B 12/382; F42B 12/42; F42B 12/46; F42B 12/48; F42B 12/50; F42B 12/56; F42B 12/70; F41J 2/02

USPC ..... 102/336, 505; 342/12

See application file for complete search history.

(56) References Cited

U.S. PATENT DOCUMENTS

| | | | | | |
|---|---|---|---|---|---|
| 4,179,270 | A | * | 12/1979 | Clayton et al. | 44/541 |
| 4,624,186 | A | * | 11/1986 | Widera et al. | 102/336 |
| 5,269,224 | A | * | 12/1993 | Gonzales et al. | 102/288 |

(Continued)

FOREIGN PATENT DOCUMENTS

| | | |
|---|---|---|
| DE | 199 51 767 A1 | 5/2001 |
| DE | 102 26 507 A1 | 12/2003 |

(Continued)

*Primary Examiner* — James S Bergin

(74) *Attorney, Agent, or Firm* — Muncy, Geissler, Olds & Lowe, P.C.

(57) ABSTRACT

An effect body is encapsulated in such a way that the encapsulation or casing supports the ignition behavior of the effect body or of the components. The effect body has a casing for accommodating the components of the effect body, which differ with regard to the chemical composition and the properties thereof. An additional component is located in the casing as an ignition aid. The effect body can be ignited through the top/side surface of the casing or by an internal ignition mixture located inside the effect body.

11 Claims, 1 Drawing Sheet

(51) Int. Cl.
*F41J 2/02* (2006.01)
*F42B 12/36* (2006.01)

(56) References Cited

U.S. PATENT DOCUMENTS

| | | | | |
|---|---|---|---|---|
| 5,585,594 | A | 12/1996 | Pelham et al. | |
| 6,513,438 | B1 | 2/2003 | Fegg et al. | |
| RE38,592 | E * | 9/2004 | Wu et al. | 102/352 |
| 7,516,700 | B1 | 4/2009 | Callaway | |
| 8,146,504 | B2 | 4/2012 | Wallner et al. | |
| 8,763,533 | B2 * | 7/2014 | Prelic et al. | 102/345 |
| 2006/0060103 | A1 * | 3/2006 | Koch et al. | 102/370 |
| 2007/0295236 | A1 * | 12/2007 | Callaway et al. | 102/336 |
| 2009/0301336 | A1 | 12/2009 | Wardecki et al. | |
| 2012/0160121 | A1 | 6/2012 | Prelic et al. | |
| 2012/0174812 | A1 | 7/2012 | Prelic et al. | |

FOREIGN PATENT DOCUMENTS

| | | | |
|---|---|---|---|
| DE | 10 2006 004 912 | A1 | 7/2007 |
| DE | 10 2005 020 159 | B4 | 10/2007 |
| DE | 196 49 892 | A1 | 7/2008 |
| WO | WO 2010/149288 | A1 | 12/2010 |
| WO | WO 2010/149290 | A1 | 12/2010 |

* cited by examiner

ENCAPSULATED EFFECT BODY FOR AN INFRARED DECOY

This nonprovisional application is a continuation of International Application No. PCT/EP2011/001008, which was filed on Mar. 2, 2011, and which claims priority to German Patent Application No. DE 10 2010 013 110.5, which was filed in Germany on Mar. 26, 2010, and which are both herein incorporated by reference.

BACKGROUND OF THE INVENTION

1. Field of the Invention

The present invention relates to an encapsulated effect body without its own ignition or ignition chain for an infrared decoy.

2. Description of the Background Art

An effect body with an ignition chain or ignition is described briefly, for example, in DE 199 51 767 C2, which corresponds to U.S. Pat. No. 6,513,438. The effect body fulfills in this context the task of a dual mode decoy. The effect material which emits radiation in the infrared range is formed here from a plurality of flares. A camouflage and decoy munition of this type for protecting objects against guided missiles, which contains mist and/or target-imitation-forming active materials is also dealt with in DE 10 2005 020 159 B4, which corresponds to US 20090301336, which is herein incorporated by reference.

Known IR effect bodies are typically have a cylindrical body which is formed by stacking individual sheets (flare leaflets or flare disks). The packet which is produced in this way is held together by a film or some other connection, for example plastic cord, etc. The film itself serves here to protect the effect body against ambient influences and for storage and transportation and in the dispensary itself. In the event of expulsion and when ignition occurs, the casing combusts and the IR effect body disintegrates in the airstream and produces a large decoy cloud.

A new ignition concept, in particular for forming decoy clouds in civil aviation, etc. without ignition and explosive materials, is described in more detail in DE 10 2006 004 912 A1, which corresponds to U.S. Pat. No. 8,146,504, which is incorporated herein by reference. Said document discloses a system for protecting, in particular, large flying platforms such as aircraft against infrared-steered or radar-steered threats. In this context, the activation or ignition of the effect bodies occurs in a contactless fashion. The expulsion of the effect bodies is then carried out pneumatically or mechanically. The effect bodies themselves are munition-free packets which are ignited by means of hot air or a laser.

The ignition behavior of the effect bodies for forming the decoy cloud still leaves room for further optimization possibilities.

SUMMARY OF THE INVENTION

It is therefore an object of the present invention to provide an effect body with optimized ignition behavior.

An embodiment of the invention is based on the idea of not surrounding the effect body with a film or the like but of instead encapsulating it in such a way that the encapsulation, for example in the form of a casing, etc. assists the ignition behavior of the effect material or of the components.

The so-called encapsulated effect body is characterized by the fact that the infrared effect body is accommodated completely in the interior of a stable, sealed and preferably combustible casing. The effect body itself is composed of one, or preferably more, individual components which have different properties and/or chemical compositions. The individual components may differ here, inter alia, in terms of ignition sensitivity, burning speed, burning period, performance, etc. The ignition speed can in addition be increased by the fact that in the interior of the casing a suitable ignition aid/ignition mixture is also additionally introduced. The ignition can occur, on the one hand, over the surface of the effect body or by means of a centrally located ignition along the longitudinal axis. The spectral properties of the combustible casing may be optimized by adding materials for changing reflection properties/absorption properties. In particular, the inputting of laser radiation can therefore be improved and the ignition speed increased.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus, are not limitive of the present invention, and wherein.

DETAILED DESCRIPTION

In the figures, 1 characterizes what is referred to as an encapsulated effect body in a sectional illustration.

Figure 1:
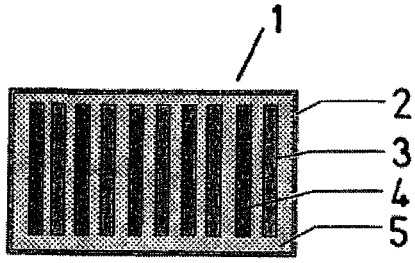
FIG. 1 shows a basic illustration of an encapsulated effect body.

FIG. 1 shows the general design of such an effect body 1, composed of a combustible casing 2, at least two flare-like components 3, 4 and an ignition aid 5, wherein the components 3, 4 can be separated from one another by the ignition aid 5 and no longer have to be stacked. The ignition aid 5 can be introduced as an additional component as a powder or granulate into the combustible casing 2. The two individual components 3, 4 are preferably different in terms of their chemical composition and their properties. It is therefore possible to combine materials with various properties such as burning, ignition sensitivity, performance, combustion period etc. Through a suitable combination of the various individual components 3, 4 it is possible to adapt the effect of the decoy to the respective requirements.

The internal geometry of the casing 2 of the effect body 1 is freely selectable. The mechanical stability and the protection against ambient influences, etc. are ensured by the casing 2.

The combustible casing can be ignited by contact with a hot surface, by inputting laser radiation, inductive ignition and further suitable methods such as, for example, friction.

If the combustible casing 2 is ignited by laser radiation, materials are advantageously added to the casing material which facilitate the transmission of the laser radiation and the ignition of the combustible casing 2. These should be materials which have the lowest possible reflection and/or high absorption at the wavelength of the laser system which is used.

Figure 2:
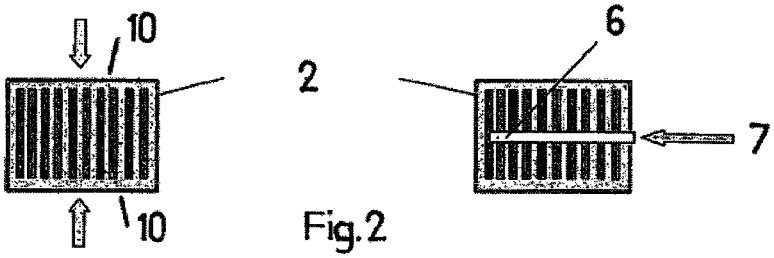
FIG. 2 shows an illustration of the ignition in two variants.

In a first variant, the ignition of the combustible casing 2 or of the effect body 1 occurs from the outside over the upper surface or lateral surface 10 of the effect body 1. Alternatively, in a further variant the ignition can take place through an internal ignition mixer 6, located in the interior of the effect body 1 using a longitudinal ignition means 7 (FIG. 2). It is, of course, also possible to combine the two variants.

Figure 3:
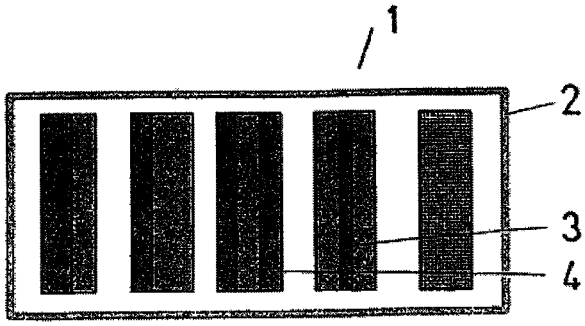
FIG. 3 shows a further embodiment of the effect body.

In a further exemplary embodiment according to FIG. 3, the described sandwich structure of the effect body 1 can also be provided in a type of combination carrier, wherein the various components 3, 4 are not located separately one next to the other/one on top of the other in the interior of the casing 2. The individual components 3, 4 could therefore already be connected to one another when the interior structure is manufactured by, for example, one component 3, 4 forming the carrier material onto which the other component or components 4, 3 is/are applied. Furthermore, it is possible to combine the individual components 3, 4 directly with one another and use them as platelets, powders, granulate or with other geometries.

The invention being thus described, it will be obvious that the same may be varied in many ways. Such variations are not to be regarded as a departure from the spirit and scope of the invention, and all such modifications as would be obvious to one skilled in the art are to be included within the scope of the following claims.

What is claimed is:

1. An effect body for an infrared decoy, the effect body comprising:

a combustible casing, at least two combustible components having different chemical compositions and properties from one another, and an ignition aid, wherein, the combustible casing accommodates the at least two combustible components and the ignition aid, wherein the effect body is ignited by igniting an upper surface or a lateral surface of the combustible casing, such that the upper surface or the lateral surface of the combustible casing forms an igniter, wherein an entire outer periphery of each of the at least two combustible components is surrounded by the ignition aid, such that the ignition aid directly contacts each of the at least two combustible components, wherein the combustible casing is formed as a single casing that accommodates both the at least two combustible components and the ignition aid therein, and wherein the ignition aid extends continuously from exterior surfaces of the at least two combustible components to an inner surface of the single casing.

2. The effect body as claimed in claim 1, wherein the ignition aid is a powder or granulate provided within the combustible casing.

3. The effect body as claimed in one of claim 1, wherein the effect body is additionally ignited by igniting an internal ignition mixture that is centrally located in an interior of the combustible casing.

4. The effect body as claimed in claim 3, wherein the internal ignition mixture is centrally located along a longitudinal axis of the combustible casing, such that the additional ignition is a longitudinal ignition.

5. The effect body as claimed in claim 1, wherein the at least two combustible components are arranged adjacent to one another or arranged on top of one another with the ignition aid also disposed between the at least combustible components.

6. The effect body as claimed in claim 1, wherein at least a portion of the at least two combustible components directly contact one another.

7. The effect body as claimed in claim 6, wherein one of the at least two combustible components forms a carrier material to which the other of the at least two combustible components is configured to be applied.

8. The effect body as claimed in claim 6, wherein the at least two combustible components are mixed together in the form of platelets, a powder, a granulate or some other geometry.

9. The effect body as claimed in claim 1, wherein the ignition aid directly contacts the inner surface of the single casing.

10. The effect body as claimed in claim 9, wherein the entire inner surface of the single casing directly contacts the ignition aid.

11. The effect body as claimed in claim 1, wherein the combustible casing is formed of a casing material and wherein materials that facilitate transmission of laser radiation are included as part of the casing material.

* * * * *